United States Patent [19]

Storm

[11] Patent Number: 4,669,993

[45] Date of Patent: Jun. 2, 1987

[54] WATER SKI TRAINING STABILIZER

[76] Inventor: F. Kristian Storm, 11400 Albata St., Los Angeles, Calif. 90049

[21] Appl. No.: 808,160

[22] Filed: Dec. 12, 1985

[51] Int. Cl.[4] ..... A63C 15/00

[52] U.S. Cl. ..... 441/68; 441/79

[58] Field of Search ..... 441/68, 74, 79

[56] References Cited

U.S. PATENT DOCUMENTS

| | | | |
|---|---|---|---|
| 3,090,978 | 5/1963 | Hanson | 441/79 X |
| 3,319,276 | 5/1967 | Penney | 441/68 |
| 3,409,920 | 11/1968 | Brownley | 441/74 |
| 4,441,446 | 4/1984 | Fichtner | 441/74 X |

FOREIGN PATENT DOCUMENTS

| | | | |
|---|---|---|---|
| 52783 | 6/1982 | European Pat. Off. | 441/74 |
| 61878 | 10/1982 | European Pat. Off. | 441/74 |
| 7811316 | 5/1979 | Netherlands | 441/74 |

*Primary Examiner*—Sherman D. Basinger

*Attorney, Agent, or Firm*—Poms, Smith, Lande & Rose

[57] ABSTRACT

A device for converting and stabilizing a narrow backed water ski member for use by beginners or handicapped persons which includes a stabilizing and training member attachable to the narrow aft portion of a narrow backed ski, the training member including an integrally elongated U-shaped member having side legs of the U-shape fitted alongside the aft ski end portion, and an aft extension on the U-shaped member interconnecting the aft ends of the side legs and fitted against the aft edge of the ski member, and securing elements for removably attaching the training member to the ski aft portion. The training member selectively increases the width and length of the aft end of the ski for increasing the area in contact with the water to enable the narrow backed ski member to be utilized as a broad backed ski member for training purposes.

1 Claim, 9 Drawing Figures

Fig. 4
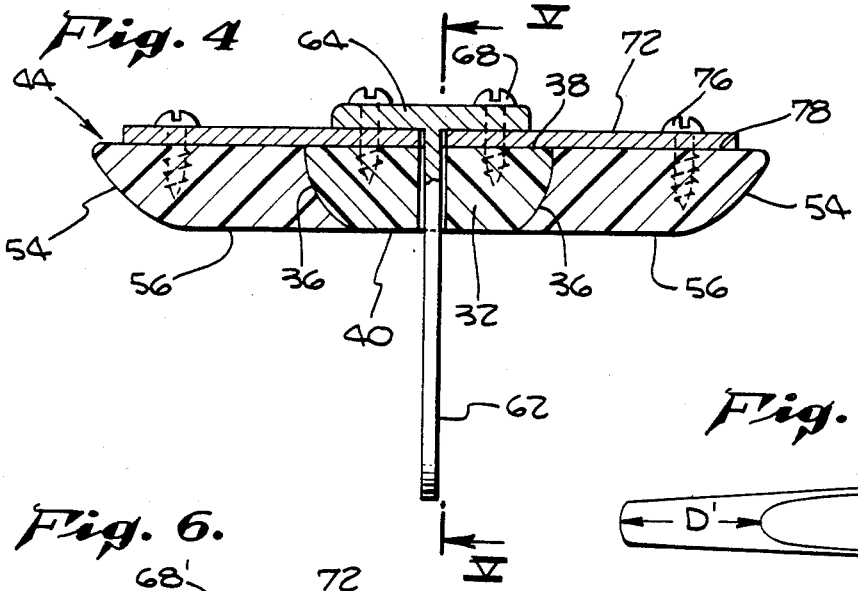
Fig. 8.
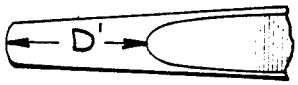
Fig. 6.
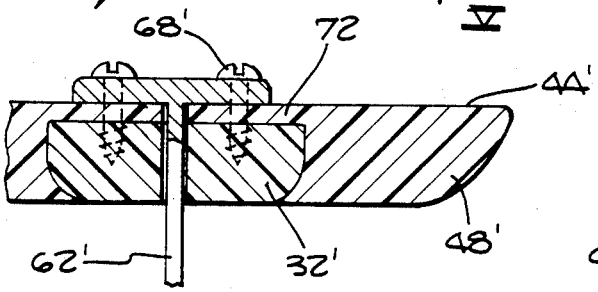
Fig. 9.
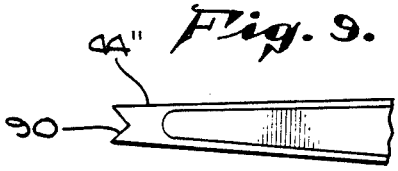
Fig. 5.
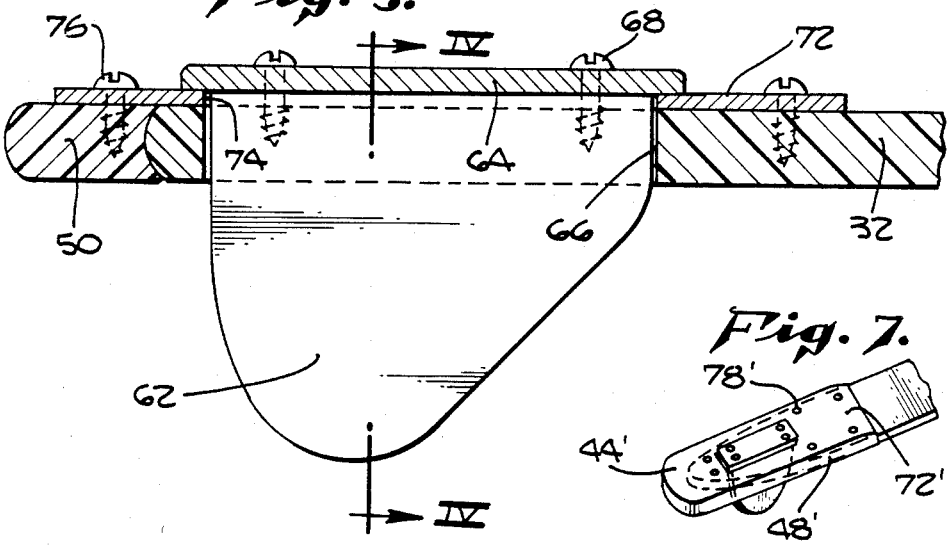
Fig. 7.

WATER SKI TRAINING STABILIZER

BACKGROUND OF THE INVENTION

Water skiing is a popular sport worldwide and over the past decade numerous varieties of slalom (single) skis have become available. The common feature of such skis is a narrow aft end (commonly 2–3 inches wide) which, while providing the necessary versatility for competitive skiing by an experienced skier, has inherent instability for the beginning or handicapped skier. Inexperienced or handicapped slalom skiers require a broad width aft end ski (typically 5 to 6 inches wide) to increase surface area contact with the water to provide additional balance and traction not possible with narrow aft end skis. In the past this problem has been remedied by learning to ski and gaining experience with a broad-backed ski, then progressively graduating to a more advanced narrow backed ski. This required the purchase of several costly skis of varying aft width.

SUMMARY OF THE INVENTION

The present invention relates to the modification of competitive narrow-backed slalom water skis as used by advanced skiers to improve stability and performance for use by inexperienced or handicapped skiers by employing a simple aft-end removably attachable water ski device. Such a removable device or stabilizing and training member stabilizes the aft end of a narrow backed slalom ski by adding neccessary width, length and area to the aft portion of the ski. The stabilizing and training member of this invention provides the user with an option of broad-backed ski advantages with a narrow-end competitive ski. In a sense the aft end stabilizer and training member of this invention is to an advanced slalom water ski as "training wheels" are to a bicycle. The invention contemplates that the stabilizing and training member of this invention may be made in any suitable configuration or any desirable or necessary shape to attach to any variation of ski design and can be easily removed without harm or modification to the ski structure.

The primary object of this invention therefore is to provide a readily removable stabilizing and training member for attachment to the narrow aft end portion of a narrow backed slalom ski to permit use of the narrow backed ski as a broad backed ski until a beginner has achieved sufficient skill to utilize the narrow backed ski.

An object of the invention is to provide a novel stabilizer member constructed and arranged to be readily removably attachable to the aft end of a narrow backed ski.

Another object of the invention is to provide a novel attachment member for a narrow backed ski which increases the effective area of the aft portion of the ski by adding selected width and length to the aft end portion of the ski.

A specific object of the invention is to provide a stabilizing and training member attachable to the narrow aft end portion of a ski member and which includes an elongated U-shaped member having side legs of the U-shape adapted to be fitted closely along side of the aft end of the ski member and an aft wall on the U-shaped member interconnecting the ends of said side legs and adapted to be fitted against the aft edge of the ski member. The invention contemplates means for securing the stablizing member to the aft end portion of the ski member in such a manner that the legs of the U-shaped member are held snugly and tightly against the side edges of the aft end portion of the ski member.

Various other objects and advantages of the present invention will be readily apparent from the following description of the drawings in which exemplary embodiments of the invention are shown.

IN THE DRAWINGS

FIG. 4 is a sectional view taken in the transverse plane indicated by line IV—IV of FIG. 5.

FIG. 5 is a sectional view taken in a vertical longitudinal plane indicated by the line V—V of FIG. 4.

FIG. 6 is a fragmentary sectional view taken in a transverse plane similar to FIG. 4 and showing a different embodiment of this invention.

FIG. 7 is a fragmentary perspective view of the aft end portion of a ski with the embodiment of the invention shown in FIG. 6 attached thereto.

FIG. 8 is a fragmentary plan view of the aft portion of a water ski with a still different embodiment of this invention.

FIG. 9 is a fragmentary plan view of the aft end of a narrow backed water ski embodying a still different embodiment of this invention.

DETAILED DESCRIPTION OF THE INVENTION

Figure 1:
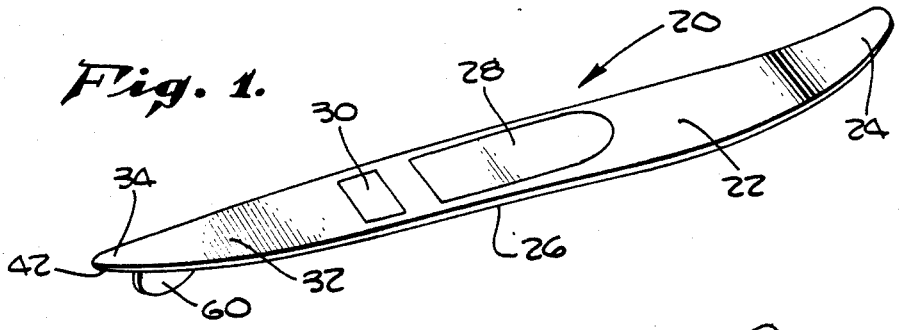
FIG. 1 is a perspective view of a narrow backed competition water ski with which the stabilizer member of this invention may be used.

A narrow backed competition type slalom water ski generally indicated at 20 is shown in FIG. 1. The ski 20 includes an elongated ski body member 22 having an upturned bow or fore portion 24, a central portion 26 provided with foot placement areas 28, 30, and a ski aft portion 32 which narrows in width rapidly from the rear foot placement area 30 to the aft end 34. As shown in FIG. 4, the side edges 36 of the narrowing aft portion 32 may be convex in cross section, beginning from the edge of the top surface 38 of the aft portion to the bottom surface 40 of the ski body member. The width of the bottom surface 40 is less than the width of the top surface 38 and presents diminishing and less bottom surface area to the water. The bottom surface width diminishes to an aft end edge 42 of relatively small width, such as two to three inches.

The water ski 20 shown in FIG. 1 has an exemplary shape of a narrow backed competition type water ski and is characterized by the rapidly narrowing aft end portion of the ski body member. It will be understood that the configuration of the ski body member may be varied by different manufacturers of water skis and the shape shown in FIG. 1 is for purposes of description and illustration.

Figure 2:
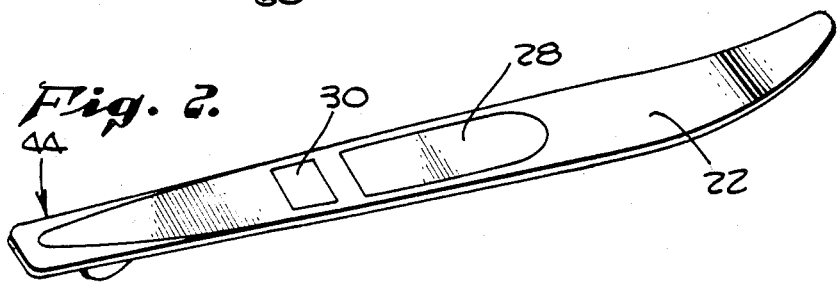
FIG. 2 is a perspective view of the ski of FIG. 1 showing the stabilizer and training member of this invention attached thereto.
Figure 3:
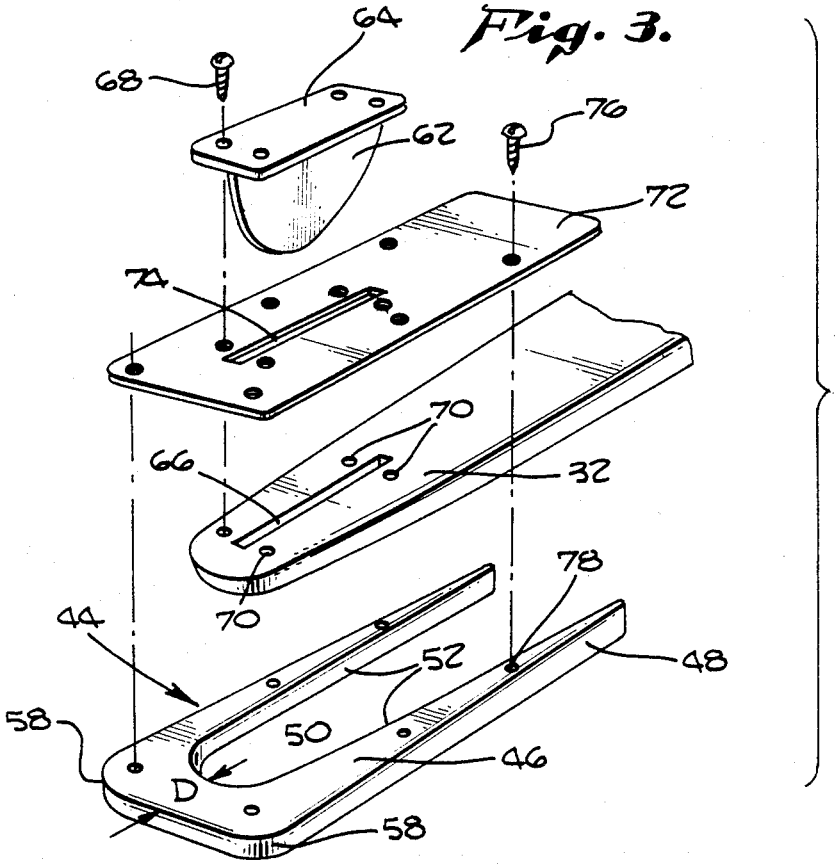
FIG. 3 is an exploded perspective view of the aft portion of the narrow backed ski and the component parts of the stabilizer and training member embodying this invention.

In FIG. 2 a stabilizing and training member of this invention is generally indicated at 44 and is attached to the aft end portion 32 of ski body member 22. The stabilizing and training member 44 may comprise an elongated U-shaped member 46, FIG. 3, having elongated legs 48 joined at one of their ends by an aft wall 50. In the example of FIGS. 3 and 4, the thickness of member 44 corresponds to the thickness of aft portion 32 of the ski member. Inboard edges 52 of legs 48 and aft wall 50 are provided edge faces of concave shape complementary to the convex edges of the ski body member 22. The outboard edges 54 of the stabilizing member may be convexly curved and the bottom faces 56 of the stabilizing member extends the bottom face 40 of the ski body member to substantially increase the surface area contacting the water at the aft end portion of the ski member. Because of the narrowing of aft portion 32, the legs 48 of the stabilizing member decrease in width from aft wall 50 to the forward end of the legs where outboard edges 54 substantially smoothly merge with edge faces of the ski body member. The width of the aft wall 50 may be not greater than the width of the ski body member at the rear foot placement area 30 since some slight decrease in width is desirable at the aft end of the ski member when equipped with the stabilizing member of this invention.

The stabilizing member 44 as shown in FIG. 3 may include aft wall corners 58 which are curved or arcuate. The longitudinal depth D of aft wall 50 serves to extend the overall length of the ski body member 22. Such extension of the overall length of the ski body member may be varied depending upon the ski training characteristics desired and as shown in FIG. 8, the longitudinal depth D' may substantially lengthen the overall length of the ski body member.

In the ski body member 20 shown in FIG. 1 a fin 60 is illustrated at the aft portion 32 and such fin may be attached to the aft portion by various means. In the fin attachment means shown in FIG. 3, fin 62 is carried by a securing plate 64 which normally rests upon the top surface of ski body member 32, the fin 62 being received within a longitudinally extending slot 66 and secured by a plurality of screw members 68 extending through suitably placed screw holes 70.

In this embodiment of the invention the stabilizing member 44 is secured to aft end portion 32 with fin 62 by providing a retention plate 72 of rectangular form and provided with a longitudinally extending slot 74 alignable with slot 66 and adapted to receive therethrough fin 62. The retention plate 72 is interposed between plate 64 and the top surface of aft end portion 32. The screw members 68 extend through retention plate 72 and into aft end portion 32 and serve to secure and fix the fin 62 in assembly with ski body member 22. The retention plate 72 extends forwardly and rearwardly of the slot 74 to cooperate with securing means such as screw members 76 which are located outboard of the edge configuration of aft portion 32 for engagement with legs 48 and aft wall 50 as indicated by the spaced screw hole openings 78 in stabilizer member 44.

As best seen in FIGS. 4 and 5, the retention plate 72 and screws 76 associated therewith provide a means for firmly securing the stabilizer member in assembly with the aft end portion 32 and the screws 68 and fin plate 64 provide a securing means for the retention plate to the aft end portion 32. The complementary configuration of the edges of the aft body portion 32 and the inboard edges 52 of the legs provides a tight and snug fit of the stabilizing member to the aft end portion of the ski body member. Such a tight and snug fit is desirable because at skiing speeds, forces exerted by the water on the ski body member and stabilizer member may tend to cause separation of the legs from the edges of the aft end portion 32. Such exaggerated separation may ultimately cause distortion of the stabilizer member and possibly separation from the ski body member at an undesirable time. The rectangular flat retention plate 72 together with the complementary configuration of the edge faces 36 and 52 assist in resisting such separation. It may be further noted that the tapering of the stabilizer member legs 48 toward their forward end tends to make such forward ends more susceptible to bending. It is desirable that the outboard edges of the legs 48 be substantially feathered to merge with the edge faces of the ski body member so that the forces exerted by the water on the forward ends of the legs are reduced.

In the modification of this invention shown in FIGS. 6 and 7, the configuration of the aft end portion 32' is substantially the same as in the prior embodiment. However, in this example the legs of the stabilizing member are formed integral with the retention plate. As shown in FIG. 6, the leg portions 48' are integrally joined with the plate portion 72'. As shown in FIG. 7, such plate portion 72' extends to the forward edge of leg portions 48' to firmly tie together and resist any separation of the forward ends of the leg portions 48' from the edges of the ski body member. In this example the screws 78 may extend into the aft end portion 32' and the screws 68' securing the fin 62' may extend through the integral portion 72' and into the aft end portion 32' as shown in FIG. 6. In view of the configuration of the edges of the aft end portion 32' and of the inboard edges of the legs 48', it will be apparent that the integral stabilizing member 44' may be slid forwardly from the aft end of the ski body member until the aft wall 54' abuts the end edge of the aft end portion 32'. In such slidably assembly it will be readily apparent that the stabilizing member provides a slot for reception of the fin assembly 62' and 64'.

In FIG. 9 stabilizer member 44'' is illustrated, such change showing an exemplary V-shaped notch 90 in the aft end edge of the stabilizer member 44''. The aft end edge may be subject to different configurations depending upon the characteristics of the ski desired.

It will be readily apparent that the stabilizer and training member 44 provides means for readily converting a competition slalom water ski member into a ski which can be utilized by a beginner or by a partially handicapped person. The advantages of such conversion are readily apparent when one considers the relative cost between a competition ski and a training ski and the necessity for purchasing both skis when one begins to ski and then progresses to more advanced competition skiing. Further, a competition type ski may be readily utilized by several and all members of a family interested in skiing and in which the conversion can be quickly made for use of a ski body member for both advanced skiing and beginning skiing.

It will be understood that the material used for making and forming the stabilizing and training member may be any solid durable material such as fiber glass, foam graphite, or substantially the same type of material as that used in fabrication of the ski body member. Further, since various ski manufacturers utilize slightly different configurations and contours of the ski body member, it will be understood that the training and stabilizing device of this invention may be custom made for a particular manufacturer's ski body member.

While a narrow backed competition ski has been used as an example, double or custom variety of water skis may be used with adaptations of the training member of this invention. Further, the means for securing the training member to the ski body member may be varied and include for example screws or other fastening elements extending sidewise through the legs into the edge faces of the ski body member.

Various changes and modifications may be made in the structure and configuration of the stabilizing and training member described hereinabove and all of such changes which come within the scope of this invention and within the scope of the appended claims are embraced thereby.

What is claimed is:

1. A device for converting and stabilizing a water ski member having a mid-portion of selected width and an aft end portion decreasing in width from said mid-portion to its aft end to provide a relatively narrow tapering aft end portion, the surfaces of the side edges and top and bottom surfaces of said mid and aft portions smoothly merging, comprising in combination:

an attachable stabilizer member for increasing the width of the tapering aft end portion to temporarily modify the functional characteristics of the ski member for use by beginners and handicapped persons;

said stabilizing member having spaced elongated side legs receiving said aft portion therebetween;

a transverse wall interconnecting one of the ends of said side legs, said wall having a lateral width greater than the width of the narrowest part of the aft portion and a longitudinal dimension extending the length of the aft portion;

said spaced side legs having a width tapering away from said connecting wall to provide external side edges smoothly merging with the side edges of the aft portion;

said side legs and said wall having an inner peripheral edge corresponding to and mating with the external side edges of the narrow aft portion;

and means removably securing said stabilizing member to said aft portion;

whereby surfaces of said stabilizer member and said narrow aft portion are continuous and minimize resistance to water flow thereover.

* * * * *